United States Patent [19]

MacDonald

[11] 4,357,120

[45] Nov. 2, 1982

[54] CONCRETE CURB CUTTER

[76] Inventor: Ian B. MacDonald, 9980 Indiana Unit 14, Riverside, Calif. 92503

[21] Appl. No.: 133,690

[22] Filed: Mar. 25, 1980

[51] Int. Cl.[3] ..... E01C 23/09; E01C 19/50

[52] U.S. Cl. ..... 404/83; 144/34 R; 83/928

[58] Field of Search ..... 404/83; 144/34 R; 299/41, 44; 125/12, 14, 13 SS; 30/379.5; 83/128 T

[56] References Cited

U.S. PATENT DOCUMENTS

| | | | |
|---|---|---|---|
| 892,895 | 7/1908 | Rose | 144/34 R |
| 951,937 | 3/1910 | Bryan | 83/928 |
| 1,016,440 | 2/1912 | Pollard | 125/14 |
| 1,039,338 | 9/1912 | Wallace | 144/34 R |
| 1,447,543 | 3/1923 | Gessman | 83/928 |
| 2,462,314 | 2/1949 | Fuqua | 83/928 |
| 2,509,092 | 5/1950 | Faulkner | 144/35 R |
| 3,129,929 | 4/1964 | Calvert | 299/39 |
| 3,148,001 | 9/1964 | Johnson | 299/75 |

FOREIGN PATENT DOCUMENTS

| | | | |
|---|---|---|---|
| 122266 | 1/1919 | United Kingdom | 83/928 |

*Primary Examiner*—William F. Pate, III

*Attorney, Agent, or Firm*—Harvey S. Hertz

[57] ABSTRACT

A concrete curb cutter includes a motor mounted on a base for supplying power to a concrete cutting blade. A first means is provided for moving the base and the blade along a longitudinal axis of a support. A second means provides adjustment of the vertical height of the blade. A third means enables the vertical angle of the blade to be adjusted. A fourth means provides adjustment of the horizontal angle of the blade.

2 Claims, 5 Drawing Figures

Fig. 4
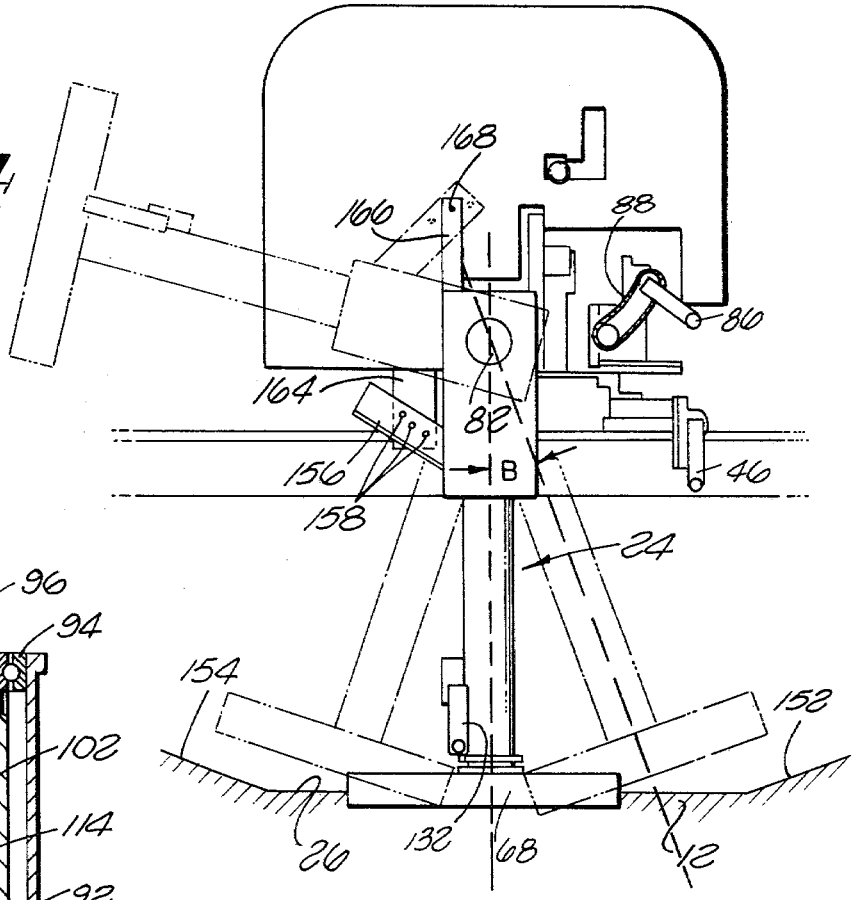
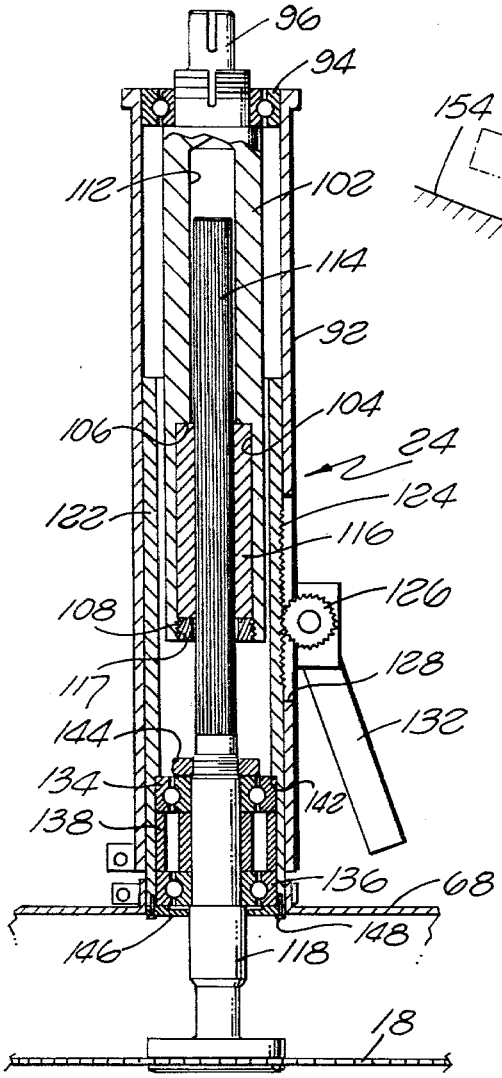
Fig. 5

CONCRETE CURB CUTTER

BACKGROUND OF THE INVENTION

1. Field of the Invention

The field of art to which the invention pertains includes the field of concrete curb cutters, particularly, with respect to a cutting blade which can be adjustably positioned in a multiplicity of angles during the cutting operation.

2. Description of the Prior Art

Concrete cutters, particularly those which are transportable and moveable during the cutting operation are generally well known. Angular adjustment of the blade enables the blade to perform a cutting operation at various given angles as well as enabling the blade and shaft to be moved to a position whereby the concrete cutting mechanism can be easily transported when in the non-operational mode. Such a device is illustrated in U.S. Pat. No. 2,783,789.

For certain specialized concrete operations, as, for example, in the cutting of a driveway curb, such devices have been found not to provide the flexibility desired in such an operation. For example, it is necessary during the cutting operation to comence the cut so that when the driveway is complete, there is a slight slope downward of the curb into the street. Where grading of the lot has not been completed it has been found rather difficult to position the blade either during the comencement of the operation or during the termination of the cutting operation at a sufficient depth so that the desired angle and cut can be provided.

The present invention enables a concrete cut be made of a curb so that the driveway can be easily formed and integrally connected to the curb without necessitating the demolition of the curb and the consequent repaving thereof. Other known prior art includes U.S. Pat. Nos. 3,360,298; 2,736,311; 2,450,523; and 2,700,256.

The present invention provides a novel concrete curb cutter whose blade can be easily adjusted so that the desired angle and length of the driveway can be easily be cut without destruction of the driveway curb and the consequent repaving thereof. Normally, a minimum of adjustments are necessary during the operation so that the entire proceedure can be made in a rather short time.

SUMMARY OF THE INVENTION

A concrete curb cutter includes a motor mounted on a base for supplying power to a concrete cutting blade. The base and blade are moveable along a longitudinal axis of a support. Means are provided for adjusting the vertical height of the blade and the vertical angle of the blade shaft. Further, the horizontal angle of the blade can be adjusted.

The advantages of this invention, both as to its construction and mode of operation, will be readily appreciated as the same becomes better understood by reference to the following detailed description when considered in connection with the accompanying drawings in which like reference numerals designate like parts throughout the figures.

BRIEF DESCRIPTION OF THE DRAWINGS

FIG. 4 is a plan view illustrating the vertical adjustment of the blade shaft; and FIG. 5 is a cross-sectional view of the blade drive support.

DESCRIPTION OF THE PREFERRED EMBODIMENTS

Figure 1:
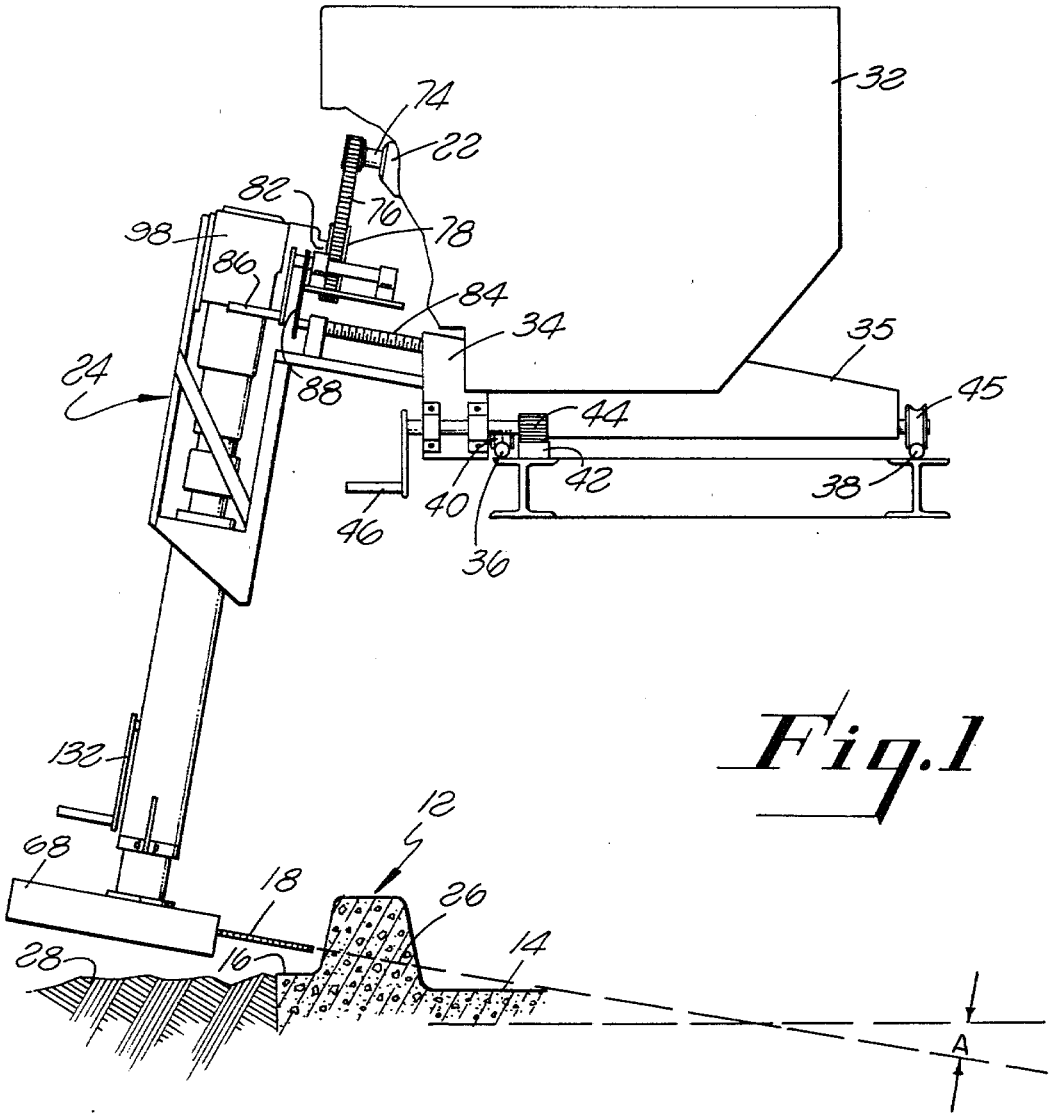
FIG. 1 is a side view of the concrete curb cutting mechanism illustrating the technique of cutting a curb.

Referring now to the drawings, there as shown in FIG. 1 a side view of a portion of the concrete curb cutter illustrating the technique for removing a portion of a concrete curb 12 so as to provide a driveway from the street side 14 to the building side 16 of the curb. The curb cutter utilizes a blade 18 which is driven by a motor 22. The motor 22 is connected to the blade 18 through a blade driven support 24 which will be described in greater detail hereinafter.

In normal operation, it is the purpose of the present invention to remove a portion of the concrete curb 12 so that a driveway can be paved from the building side 16 of the curb to the street side 14. In prior art techniques the curb was destroyed in the area where the driveway was to be formed and subsequently repaved. The present invention allows a driveway to be cut from an existing curb thus eliminating the need for repaving the curb.

The present invention utilizes the blade 18 so that it is placed at a slight angle with respect to the longitudinal plane of the street and then the motor 22 actuated to enable the blade 18 to cut the curb 12 from the building side 16 to the street side 14. A cut 26, shown in dotted line in FIG. 1 enables the blade 18 to be placed on the building side 16 of the curb where debris 28 would normally prevent the blade from being positioned in a lower horizontal plane. In addition, it should be noted that the slope of the cut 26 from the building side 16 to the street side 14 enables a normal flow of drainage into the street.

Figure 2:
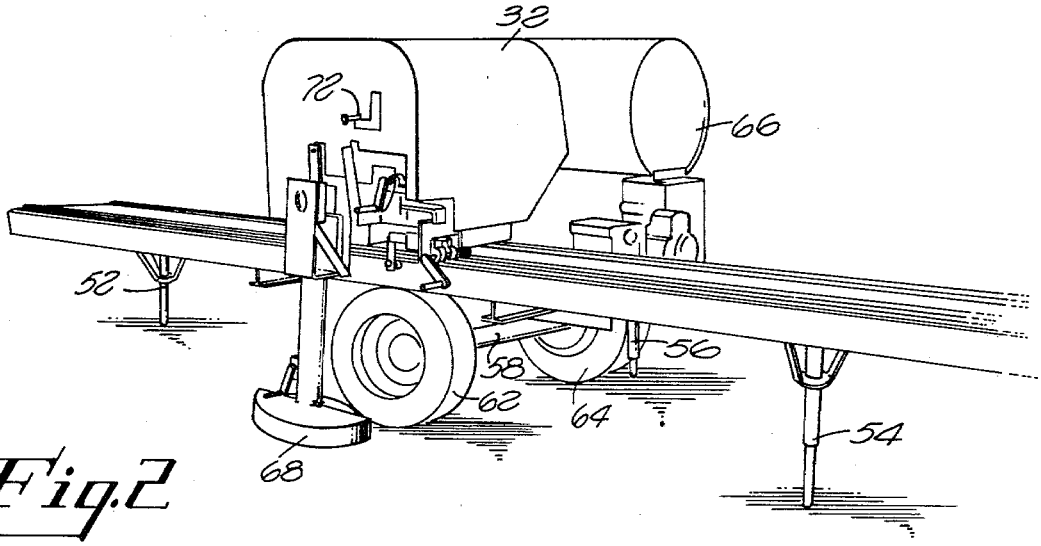
FIG. 2 is a perspective view of the concrete curb cutting mechanism of FIG. 1.

Referring now to FIG. 2, The concrete curb cutter is shown in greater detail in perspective view. The curb cutter includes a motor housing 32 (partially broken away in FIG. 1) which is mounted on a moveable base 34. The base 34 includes a trolley 35 which moves along a pair of longitudinal tracks 36, 38, the track 36 having a trolley wheel 40 moveable thereon and a rack 42 positioned adjacent thereto. The rack 42 meshes with a rotatable gear 44 attached to one side of the trolley 35, and wheel 45 moves along the track 38 (FIG. 1).

After the curb 12 has initially been cut through the line 26 of FIG. 1, a crank 46 which is connected directly to the gear 44 is rotated causing the base 34 and trolley 35 to move along the longitunal tracks 36,38 and complete the curb cutting procedure for the desired length of the curb in a first plane. Subsequent plane cutting procedures will be explained hereinafter.

The longitudinal tracks 36, 38 are supported by means of a first end support jack 52 and a second end support jack 54 enabling the tracks 36,38 to be positioned at a desired height and level. In addition, a centrally positioned angle adjustment jack 56 enables the tracks 36,38 to be moved with respect to the horizontal plane so that the desired angle of the blade 18 is achieved with respect to the curb 12 as shown in FIG. 1. The track structure is secured to a conventional trailer housing 58 which in turn is supported by a pair of wheels 62,64 thus enabling the concrete curb cutter to be transported to a construction location by collapsing the support jacks 52, 54 as well as the angle adjustment jack 56.

A water coolent tank 66 is also secured to the trailer housing 58 and has a connection (not shown) for supplying water to the blade 18 adjacent the blade guard 68 so as to enable the blade 18 to be cooled as it rotates during the cutting procedure.

The motor 22 is typically a gasoline driven motor which is engaged by means of a clutch mechanism 72 which protrudes through the motor housing 32. As seen in FIG. 1, the motor 22 has an output shaft 74 which drives a drive chain 76. The drive chain 76 in turn rotates a gear 78. The gear 78 is connected to an output shaft 82 which in turn is coupled through a right angle gear box 98 to the driving member of the blade driven support 24.

The moveable base 34 is also adjustable along an axis parallel to the axis of the motor output shaft 74, while the trolley 35 remains fixed, by means of a lead screw 84. A crank 86 rotates the lead screw 84 through a chain connection 88, enabling the base 34 and motor housing to move parallel to the axis of the lead screw 84.

Figure 3:
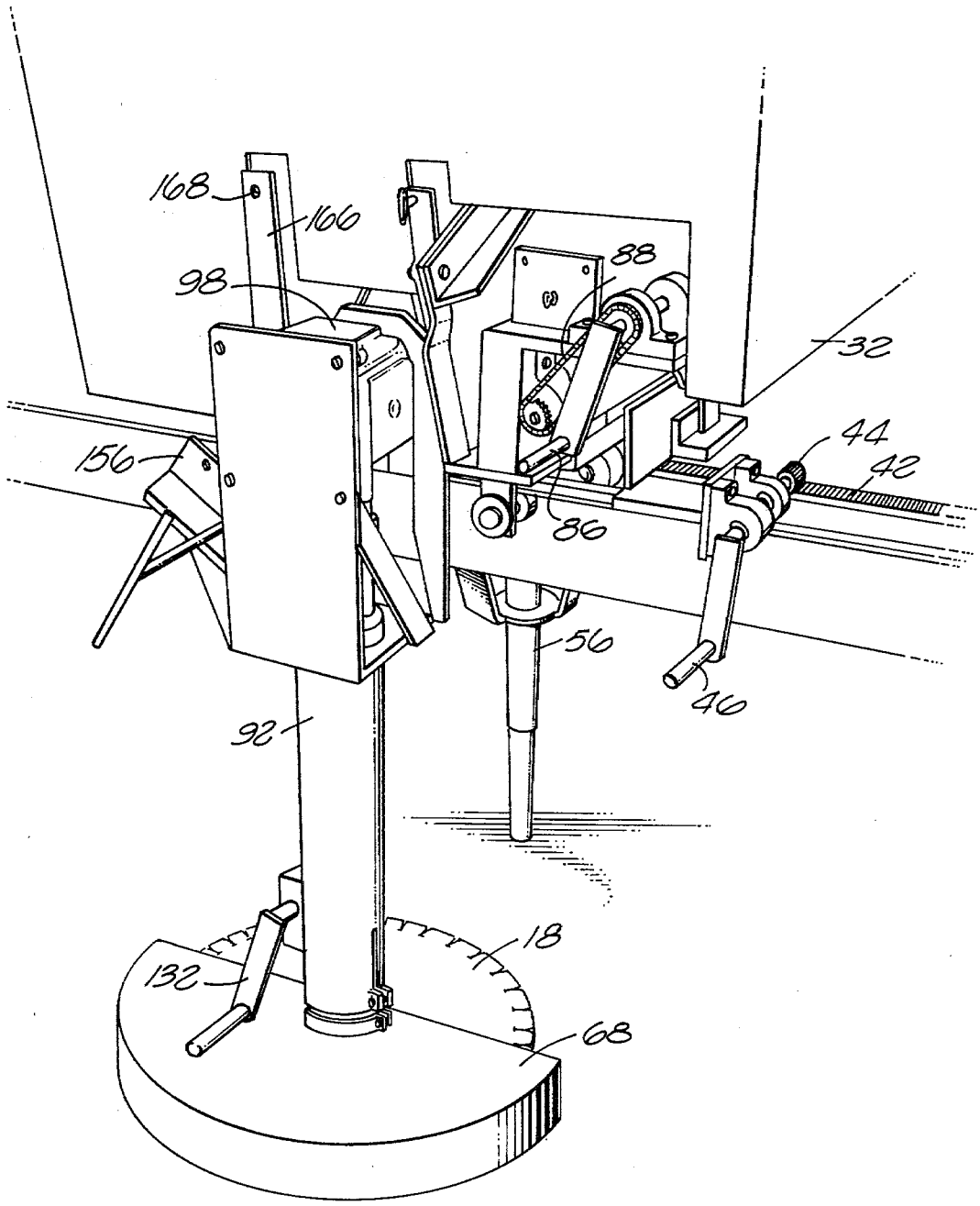
FIG. 3 is a perspective view in greater detail of the concrete curb cutter of FIG. 1.

Referring now to FIG. 5 the blade drive and support 25 are shown in greater detail. A drive housing 92 has a bearing 94 positioned at the top end thereof enabling the drive shaft 96 to extend therethrough. The drive shaft 96 is connected through a right angle gear box 98 (FIG. 3) to the output shaft 82 of FIG. 1. Positioned directly below and directly connected to the drive shaft 96 is a rotatable inner housing 102 which rotates with the drive shaft 96.

The rotatable inner housing 102 contains an enlarged diameter downwardly extendingly bore 104 which terminates at a downwardly facing shoulder 106. The bore 104 extends from the shoulder 106 to the bottom end of the rotatable housing 102. The end of the bore 104 contains a threaded surface 108. A reduced diameter bore 112 in the rotatable housing 102 extends from the shoulder 106 to adjacent the housing connection with the drive shaft 96.

A spline 114 is positioned and vertically moveable in the coaxial bores 104 and 112 and has a diameter slightly less than that of the reduced diameter bore 112. Power is transmitted from the rotatable inner housing 102 to the spline 114 by means of a splined bushing 116 which is positioned in the enlarged diameter bore 104 and secured therein by means of a nut 117 which is threadably secured in the threaded inner surface 108. The bottom end of the spline 114 in turn is integrally formed with a blade shaft 118 having the blade 18 secured thereto.

To provide axial adjustment of the shaft 118, a sleeve 122 is positioned intermediate the inner surface of the drive housing 92 and the rotatable inner housing 102. The sleeve 122 is axially adjustable by means of a rack 124 formed on the sleeve outer surface which meshes with a rotatable gear 126. The rotatable gear 126 extends through an elongated slot 128 formed in the wall of the drive housing 92. As can be seen, rotation of a crank 132 will cause axial movement of the sleeve 122 in the drive housing 92.

The sleeve 122 is also used to support the blade shaft 118 in the drive housing 92. A pair of bearings 134 and 136 having a spacer 138 therebetween are mounted so that the top end of the bearing 134 as shown in FIG. 5, abuts a downwardly facing shoulder 142 formed in the interior of the sleeve 122 surface. A nut 144 is threaded onto the shaft 118 and abuts the top surface of the inner race of the bearing 134. An end cap 146 retains the bearings 134, 136 and the spacer 138 within the sleeve 122 and is secured to the end of the sleeve 122 by means of screws 148. When it is necessary to remove the blade shaft 118 from the drive housing 92, the end cap 146 is removed.

Referring now to FIG. 4, the technique for cutting the curb is illustrated in greater detail. As previously described the blade 18 passes through the concrete curb 12 along the cut line 26. Once the initial cut has been performed, the trolley 35 is moved along the longitudinal tracks 36 and 38 until the cut 26 as shown in FIG. 4 is complete. The blade 18 is then moved by means of rotation of the blade drive and support 24 at the right angle gear box 98 until the blade is parallel to a right end cut 152 or a left end cut 154. Normally these cuts are made while the trolley is in a fixed position.

To position the blade 18 so that the cut 152 or 154 can be performed, an angle bracket 156 is secured to the blade drive support 24. The angle bracket 156 contains openings 158 therein through which a securing pin (not shown) can pass. The pin is also passed through an opening in a tab 164 depending downwardly from the base 34. In addition is should be noted that a travel securing tab 166 enables the blade drive and support 24 to be positioned in the upper left position shown in FIG. 4 when it is necessary to transport the entire concrete curb cutter to a different construction site. In the transport mode, the securing pin is passed through the angle bracket opening 158 and an opening 168 in the travel securing tab 166.

I claim:

1. A concrete curb cutter comprising:

a motor mounted on a base supplying power to a concrete cutting blade and means operatively associated with said curb cutter for moving said blade to a predetermined cutting position including:

first means connected to said base for moving said base and blade along a longitudinal axis of a support comprising a trolley moveable along a track mounted on said support;

second means for adjusting the vertical height of said blade, said second means interconnecting said blade and said motor;

third means connecting said second means to one of a plurality of positions with respect to said base for adjusting vertical angle of said blade shaft;

fourth means connected to said support for adjusting the horizontal angle of said blade; and fifth means interconnecting said base and said second means for moving said motor in a plane transverse to said longitudinal axis of said support.

2. A concrete curb cutter in accordance with claim 1 wherein said fourth means comprises a jack position in a plane generally perpendicular to a horizontal plane.

* * * * *